US009953794B2

(12) United States Patent
Ikeda et al.

(10) Patent No.: US 9,953,794 B2
(45) Date of Patent: Apr. 24, 2018

(54) ELECTRIC CONNECTION BOX AND WIRE HARNESS

(71) Applicant: YAZAKI CORPORATION, Tokyo (JP)

(72) Inventors: Tatsuhiko Ikeda, Shizuoka (JP); Takaaki Kakimi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/153,151

(22) Filed: May 12, 2016

(65) Prior Publication Data

US 2016/0351368 A1 Dec. 1, 2016

(30) Foreign Application Priority Data

May 29, 2015 (JP) ..... 2015-109443

(51) Int. Cl.
*H01H 85/20* (2006.01)
*H01H 85/02* (2006.01)
(Continued)

(52) U.S. Cl.
CPC ..... *H01H 85/20* (2013.01); *H01H 85/0241* (2013.01); *H01H 2085/208* (2013.01)

(58) Field of Classification Search
CPC .... H01H 85/20; H01H 85/04; H01H 85/0241; H01H 2085/208; H01B 7/0045
(Continued)

(56) References Cited

U.S. PATENT DOCUMENTS 5,438,310 A * 8/1995 Ikari ..... H01H 85/20 337/186
5,643,693 A * 7/1997 Hill ..... H01M 2/348 429/121
(Continued)

FOREIGN PATENT DOCUMENTS

CN 103415906 A 11/2013
JP 2003-125517 A 4/2003
(Continued)

OTHER PUBLICATIONS

Japanese Office Action for the related Japanese Patent Application No. 2015-109443 dated May 23, 2017.
(Continued)

*Primary Examiner* — Anatoly Vortman
(74) *Attorney, Agent, or Firm* — Kenealy Vaidya LLP

(57) ABSTRACT

An electric connection box includes a circuit protection component, a housing, and a metal heat conductive member. The circuit protection component is provided with a metal circuit protection member. The circuit protection member includes a power supply side connector that is electrically connected to power supply side electric wires connected to a power supply side, load side connectors that are electrically connected to load side electric wires connected to a load side, and fuse elements interposed between the power supply side connector and the load side connectors. The housing is formed of an insulating material, and includes a protection component holding unit that holds the circuit protection component. The heat conductive member includes a contacting portion that contacts the power supply side connector in a state where the protection component holding unit holds the circuit protection component, and a heat conducting portion connected to the contacting portion.

18 Claims, 12 Drawing Sheets

(51) Int. Cl.
*H01B 7/00* (2006.01)
*H01H 85/04* (2006.01)

(58) Field of Classification Search
USPC ..... 337/191
See application file for complete search history.

(56) References Cited

U.S. PATENT DOCUMENTS 5,748,068 A * 5/1998 Kiyota ..... H01R 9/223 337/186
5,755,579 A * 5/1998 Yanase ..... H02G 3/16 439/76.2
6,294,978 B1 * 9/2001 Endo ..... H01H 85/044 337/159
6,509,824 B2 * 1/2003 Inaba ..... H01H 85/044 29/623
6,759,938 B2 * 7/2004 Matsumura ..... H01H 85/044 337/161
8,419,443 B2 4/2013 Kamo
2002/0170732 A1 * 11/2002 Chiriku ..... H01H 50/12 174/59
2004/0080923 A1 * 4/2004 Janisch ..... B60R 16/0239 361/826
2005/0153583 A1 * 7/2005 Kawamura ..... H01R 9/2458 439/76.2
2006/0040526 A1 * 2/2006 Shirota ..... B60R 16/0238 439/76.2
2009/0108982 A1 * 4/2009 Ohashi ..... H01H 85/044 337/191
2011/0306221 A1 12/2011 Kamo
2013/0316584 A1 11/2013 Taguchi et al.
2014/0246217 A1 * 9/2014 I ..... H05K 5/06 174/50.5

FOREIGN PATENT DOCUMENTS

JP 2012-5162 A 1/2012
JP 2012-216337 A 11/2012
WO 2012/133459 A1 10/2012

OTHER PUBLICATIONS

Chinese Office Action for the related Chinese Patent Application No. 201610362563.4 dated Aug. 31, 2017.

* cited by examiner

ELECTRIC CONNECTION BOX AND WIRE HARNESS

CROSS-REFERENCE TO RELATED APPLICATION(S)

The present application claims priority to and incorporates by reference the entire contents of Japanese Patent Application No. 2015-109443 filed in Japan on May 29, 2015.

BACKGROUND OF THE INVENTION

1. Field of the Invention

The present invention relates to an electric connection box and a wire harness.

2. Description of the Related Art

Conventionally, there have been known an electric connection box disposed between a power supply and a plurality of loads installed in a vehicle, and a wire harness including the electric connection box. As an example of the electric connection box, there has been known an electric connection box including a circuit protection component such as a fusible link. The circuit protection component is provided with a metal circuit protection member including a fuse element, and is connected to an electric wire on a power supply side and an electric wire on a load side while this fuse element is interposed therebetween. When a current equal to or larger than a predetermined value flows, this circuit protection component fuses a fuse element by self-heating, and interrupts power supply to the load side. Japanese Patent Application Laid-open No. 2012-216337 discloses this kind of circuit protection component (fusible link).

In a circuit protection component, a part connected to an electric wire on a power supply side receives heat of the electric wire, and the heat is conducted to a fuse element side. Thus, in a circuit protection component, a temperature of a fuse element may rise to a temperature at which the fuse element can be fused before a current equal to or larger than a predetermined value flows, and the fuse element may be fused.

SUMMARY OF THE INVENTION

An object of the present invention is to provide an electric connection box and a wire harness capable of improving accuracy of a circuit protection component.

In order to achieve the above mentioned object, an electric connection box according to one aspect of the present invention includes a circuit protection component that is provided with a metal circuit protection member, the circuit protection member including a power supply side connector that is electrically connected to power supply side electric wires connected to a power supply side, load side connectors that are electrically connected to load side electric wires connected to a load side, and fuse elements that are interposed between the power supply side connector and the load side connectors; a housing that is formed of an insulating material, and includes a protection component holding unit that holds the circuit protection component; and a metal heat conductive member that includes a contacting portion contacting the power supply side connector in a state where the protection component holding unit holds the circuit protection component, and a heat conducting portion connected to the contacting portion.

According to another aspect of the present invention, in the electric connection box, it is desirable that the protection component holding unit is a protection component holding body that is housed and held in the housing and being independent from the housing.

According to still another aspect of the present invention, in the electric connection box, it is desirable that the protection component holding unit includes the heat conductive member in a state where the heat conductive member is communicated with outside of the protection component holding unit.

According to still another aspect of the present invention, in the electric connection box, the housing may be interposed between the load side connectors and the load, and may hold an electric component that is electrically connected to the load side connectors and the load.

According to still another aspect of the present invention, in the electric connection box, when a plurality of loads are prepared, the circuit protection member may include the load side connector and the fuse element for each of the loads.

In order to achieve the above mentioned object, a wire harness according to still another aspect of the present invention includes power supply side electric wires that are connected to a power supply side; load side electric wires that are connected to a load side; a circuit protection component that is provided with a metal circuit protection member, the circuit protection member including a power supply side connector that is electrically connected to the power supply side electric wires, load side connectors that are electrically connected to the load side electric wires, and fuse elements that are interposed between the power supply side connector and the load side connectors; a housing that is formed of an insulating material and, includes a protection component holding unit that holds the circuit protection component; and a metal heat conductive member that includes a contacting portion contacting the power supply side connector in a state where the protection component holding unit holds the circuit protection component, and a heat conducting portion connected to the contacting portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

An embodiment of an electric connection box and a wire harness according to the present invention will now be described in detail with reference to the accompanying drawings. This embodiment is not intended to limit this invention.

Embodiment

An embodiment of an electric connection box and a wire harness according to the present invention will be described with reference to FIGS. 1 to 13.

Figure 1:
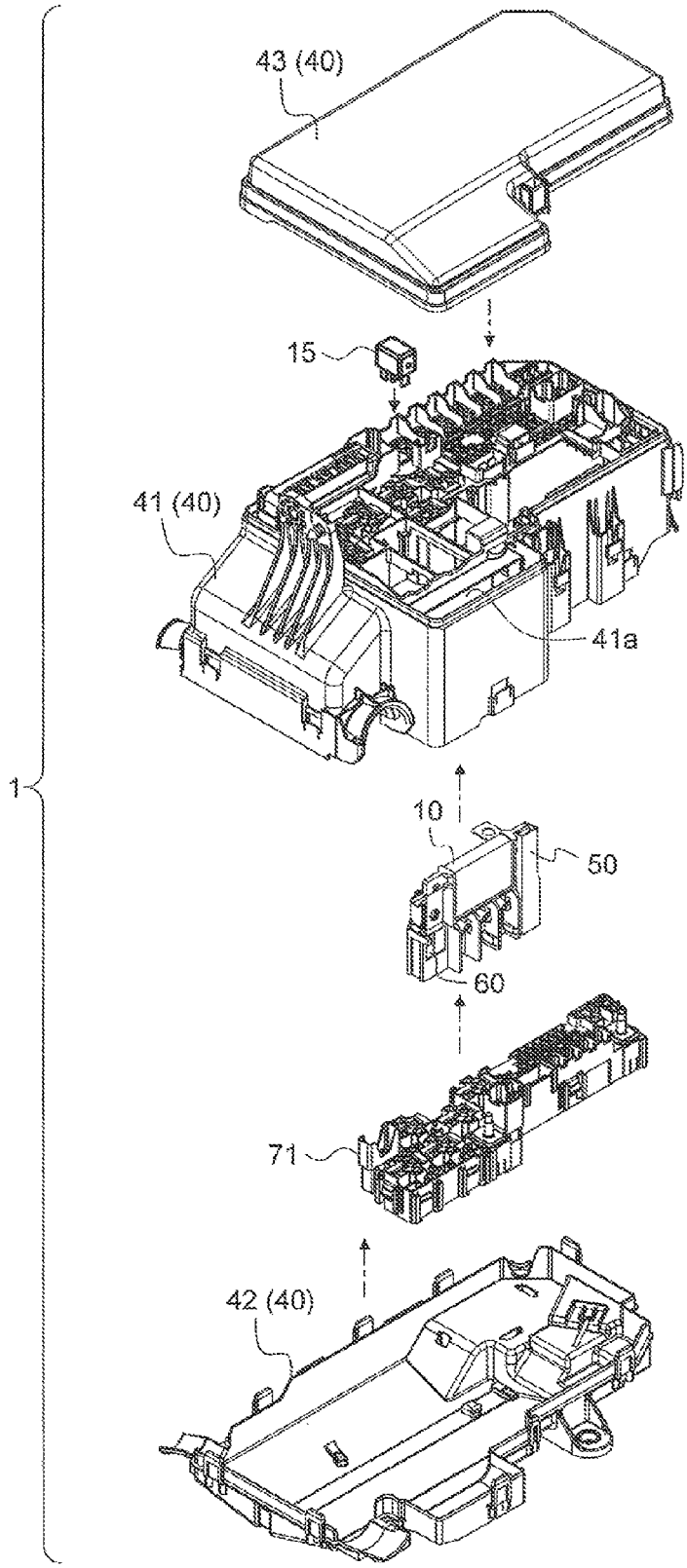
FIG. 1 is an exploded perspective view illustrating an electric connection box according to an embodiment.
Figure 2:
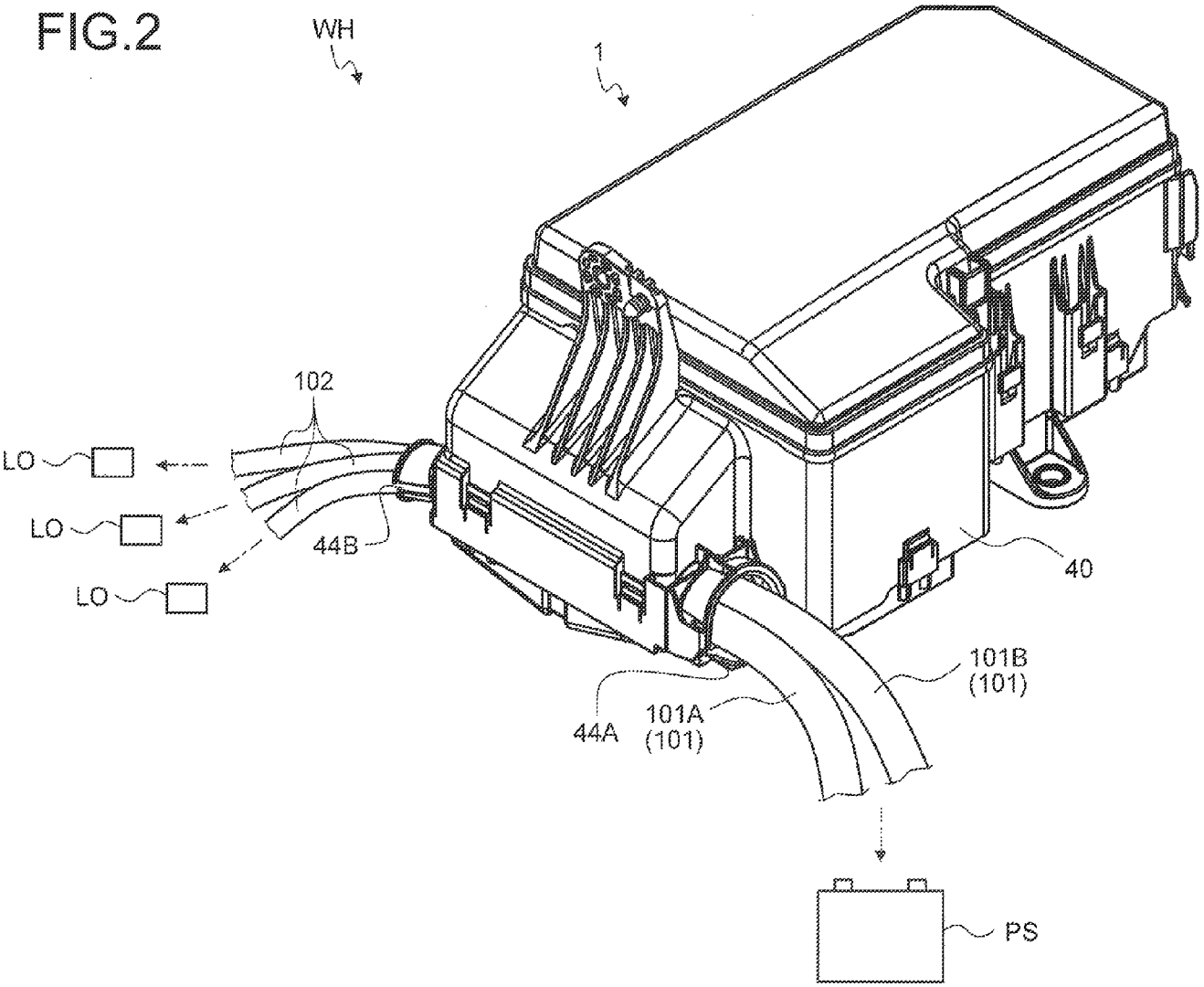
FIG. 2 is a perspective view illustrating the electric connection box and a wire harness according to the embodiment.

A numeral 1 in FIGS. 1 and 2 denotes an electric connection box in the embodiment. A symbol WH in FIG. 2 denotes a wire harness including the electric connection box 1.

The electric connection box 1 in the embodiment is interposed between a power supply (secondary battery) PS and a load LO, and includes at least a circuit protection component 10 for protecting an electric circuit between the power supply PS and the load LO. Examples of the circuit protection component 10 include a fuse and a fusible link. The electric connection box 1 may be referred to as a fuse box when the box does not include electric system components (except for electric wires) other than the circuit protection component 10.

Electric wires connected to the power supply PS side (hereinafter, referred to as "power supply side electric wires") 101 are connected to the electric connection box 1. The power supply side electric wires 101 are roughly classified into an electric wire connected to a positive electrode side of the power supply PS (hereinafter, referred to as a "positive electrode side electric wire") 101A and an electric wire connected to a negative electrode side of the power supply PS (hereinafter, referred to as a "negative electrode side electric wire") 101B. One ends of the power supply side electric wires 101 (the positive electrode side electric wire 101A and the negative electrode side electric wire 101B) according to the embodiment are electrically connected to the electric connection box 1, and the other ends of the power supply side electric wires 101 are electrically connected to the power supply PS. In addition, electric wires connected to the load LO side (hereinafter, referred to as "load side electric wires") 102 are connected to the electric connection box 1. The wire harness WH corresponds to the electric connection box 1 to which at least the power supply side electric wires 101 (the positive electrode side electric wire 101A and the negative electrode side electric wire 101B) and the load side electric wires 102 are being connected.

The electric connection box 1 in the embodiment includes not only the circuit protection component 10 but also an electric component 15 such as a relay interposed between the circuit protection component 10 and the load LO (FIG. 1). The electric component 15 is interposed between, for example, load side connectors 22, which will be described later, of the circuit protection component 10 and the load LO, and is electrically connected to the load side connectors 22 and the load LO. In this manner, the electric connection box 1 and the wire harness WH in the embodiment can adjust the power supply from the power supply PS to the load LO. The electric component 15 is housed in and held by a housing 40, which will be described later. The electric connection box 1 in the embodiment may be referred to as a relay box, a junction box, and the like. FIG. 1 illustrates only one electric component 15 for convenience of illustration.

For example, the electric connection box 1 and the wire harness WH are installed in a vehicle, and are interposed between the power supply PS (secondary battery) of the vehicle and an electric device as the load LO. The following describes a specific example of the electric connection box 1 and the wire harness WH in the embodiment.

Figure 3:
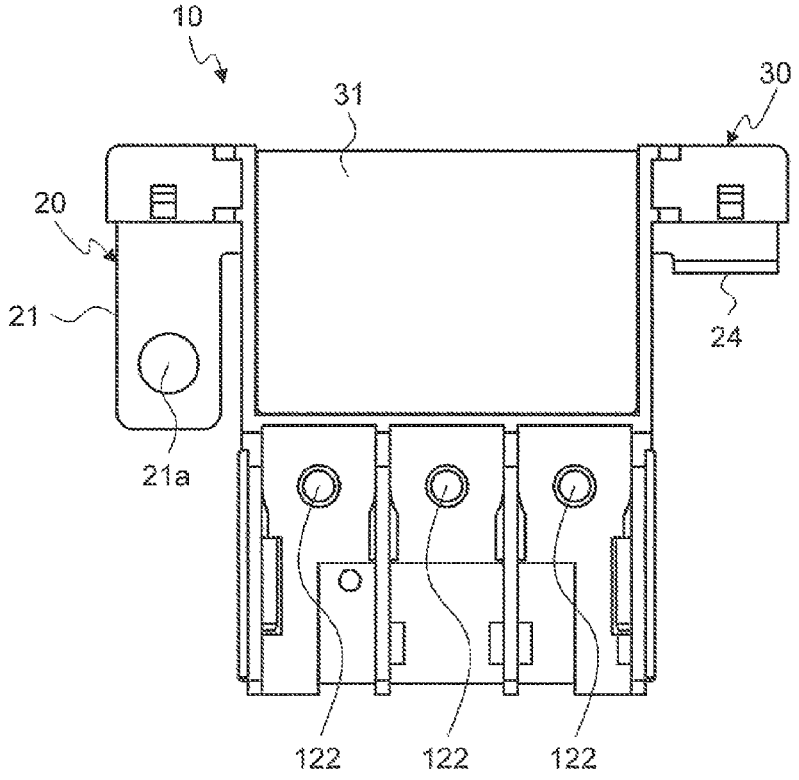
FIG. 3 is a front view illustrating a circuit protection component according to the embodiment.
Figure 4:
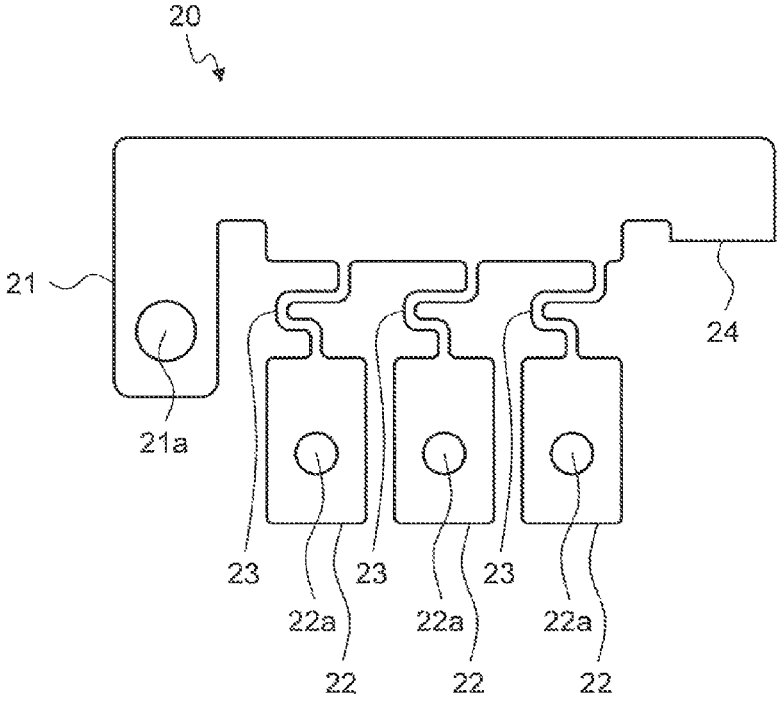
FIG. 4 is a front view illustrating a circuit protection member according to the embodiment.
Figure 5:
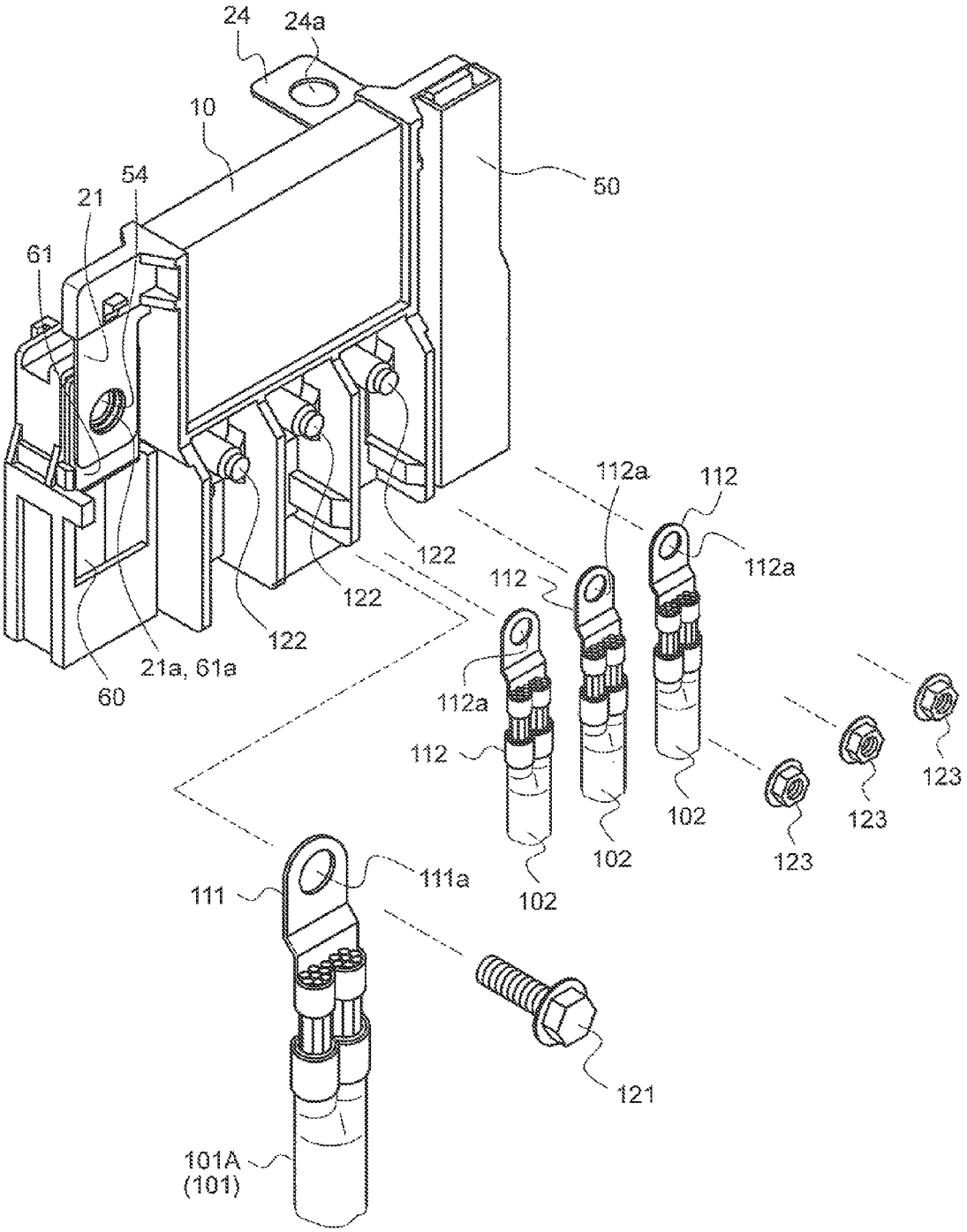
FIG. 5 is a perspective view illustrating a joint body of the circuit protection component and a protection component holding body according to the embodiment.

The circuit protection component 10 provided to the electric connection box 1 includes a circuit protection member 20 and a housing member 30 (FIGS. 3 and 4). The circuit protection component 10 in the embodiment is exemplified as a fusible link.

The circuit protection member 20 is a metal member for protecting an electric circuit between the power supply PS and the load LO. This circuit protection member 20 is formed by press-working a plate-like metal material. This circuit protection member 20 includes a power supply side connector 21 electrically connected to the power supply side electric wires 101, load side connectors 22 electrically connected to the load side electric wires 102, and fuse elements 23 interposed between the power supply side connector 21 and the load side connectors 22 (FIG. 4). When a plurality of load LOs are prepared, the circuit protection member 20 includes the load side connector 22 and the fuse element 23 for each of the load LO. In this example, three sets of combination of the load side connector 22 and the fuse element 23 are provided corresponding to three load LOs.

The housing member 30 houses therein the circuit protection member 20 in a state where a part connected to the power supply side electric wires 101 of the power supply side connector 21 is exposed to the outside. If conductivity is established between the load side connectors 22 and the load side electric wires 102, the load side connectors 22 are not necessarily exposed to the outside. The housing member 30 is formed of an insulating material such as a synthetic resin. For example, the housing member 30 may have a space for housing the circuit protection member 20 and insert the circuit protection member 20 into the housing space. In this example, the housing member 30 is formed by insert-molding, that is, by inserting the circuit protection member 20 into a molding die of the housing member 30 and integrating a synthetic resin infused into the inside of the molding die with the circuit protection member 20. A visually recognizing unit 31 that is transparent or translucent is provided around the fuse elements 23 so that a state of the fuse elements 23 (presence or absence of fusion) is visually recognized from the outside (FIG. 3). The visually recognizing unit 31 may be integrally formed as a part of the housing member 30, and may be provided as a member different from the housing member 30.

Specifically, the power supply side connector 21 is a plate-like unit formed into an L shape. The power supply side electric wires 101 may be connected to this power supply side connector 21 in any form. Examples of the connection form include screw fixing and welding. In the embodiment, a terminal 111 is electrically connected to an end part of the power supply side electric wires 101 (FIG. 5), and the power supply side connector 21 and the power supply side electric wires 101 are electrically connected to each other through this terminal 111. In the embodiment, the positive electrode side electric wire 101A is connected to the power supply side connector 21. For example, in the power supply side connector 21 in the embodiment, a through hole 21*a* is formed on one piece out of two pieces forming the L shape. The through hole 21*a* is formed into a round shape, and is disposed concentrically to a round through hole 111*a* of the terminal 111 and a female screw unit 54 of a protection component holding body 50, which will be described later. The power supply side connector 21 and the terminal 111 are fastened together by the female screw unit 54 and a male screw member 121. In the embodiment, the power supply side connector 21 is interposed between the female screw unit 54 and the terminal 111. In this manner, the power supply side connector 21 and the positive electrode side electric wire 101A are electrically connected to each other.

Each of the load side connectors 22 is a plate-like unit formed into a rectangular shape, and is arranged in a line at intervals from each other. The load side electric wires 102 may be connected to the load side connectors 22 in any form. Examples of the connection form include screw fixing and welding. In the embodiment, terminals 112 are electrically connected to an end part of the load side electric wires 102 (FIG. 5), and the load side connectors 22 and the load side electric wires 102 are electrically connected to each other through the terminals 112. For example, in the load side connectors 22 in the embodiment, round through holes 22*a* are formed (FIG. 4). In this example, male screw members 122 like metal stud bolts are inserted through the through holes 22*a* (FIG. 5), and the circuit protection member 20 and the housing member 30 are insert-molded in a state where the load side connectors 22 and the male screw members 122 are electrically conducted to each other. The terminals 112 are fixed to the circuit protection component 10 by screwing metal female screw members 123 with the male screw members 122 in a state where round through holes 112*a* are inserted through the male screw members 122. The load side connectors 22 and the load side electric wires 102 are electrically connected to each other through the terminals 112, the male screw members 122, and the female screw members 123.

The fuse elements 23 are interposed between the other piece out of the two pieces of the power supply side connector 21 and the load side connectors 22. The sectional area of the fuse elements 23 is smaller than that of the power supply side connector 21 and that of the load side connectors 22. Thus, the fuse elements 23 are fused by Joule heat when a current equal to or larger than a predetermined level flows. A current value at which the fuse elements 23 are fused is defined by the sectional area of the fuse elements 23, the path length of the fuse elements 23 between the power supply side connector 21 and the load side connectors 22, and the like.

The circuit protection member 20 is provided with a piece unit 24 projecting in an orthogonal direction from the other piece out of the two pieces of the power supply side connector 21. The piece unit 24 is exposed to the outside of the housing member 30, and includes a round through hole 24*a*. The through hole 24*a* is inserted through a cylindrical projecting unit 71*c* of a protection component holding member 71, which will be described later.

The electric connection box 1 includes the housing 40 that houses therein this circuit protection component 10. The housing 40 is formed of an insulating material such as a synthetic resin. The housing 40 in the embodiment includes a housing body 41 having both ends facing each other opened, a first lid body 42 for covering one opening of the housing body 41, and a second lid body 43 for covering the other opening of the housing body 41 (FIG. 1).

The circuit protection component 10 is housed in a housing chamber 41*a* inside the housing body 41, and is held by the protection component holding unit 50 inside the housing body 41. The protection component holding unit 50 may be integrally formed as a part of the housing body 41, and may be provided as a member different from the housing body 41. In the electric connection box 1 in the embodiment, the protection component holding unit 50 is prepared as a member different from the housing body 41 (hereinafter, referred to as the "protection component holding body 50").

The protection component holding body 50 is formed of an insulating material such as a synthetic resin. The protection component holding body 50 is housed in and held by the housing body 41. The protection component holding body 50 includes an engaging unit 51 for engaging the circuit protection component 10 (FIGS. 6 to 8), and a locking unit 52 for locking the circuit protection component 10 (FIGS. 6 to 9).

Figure 9:
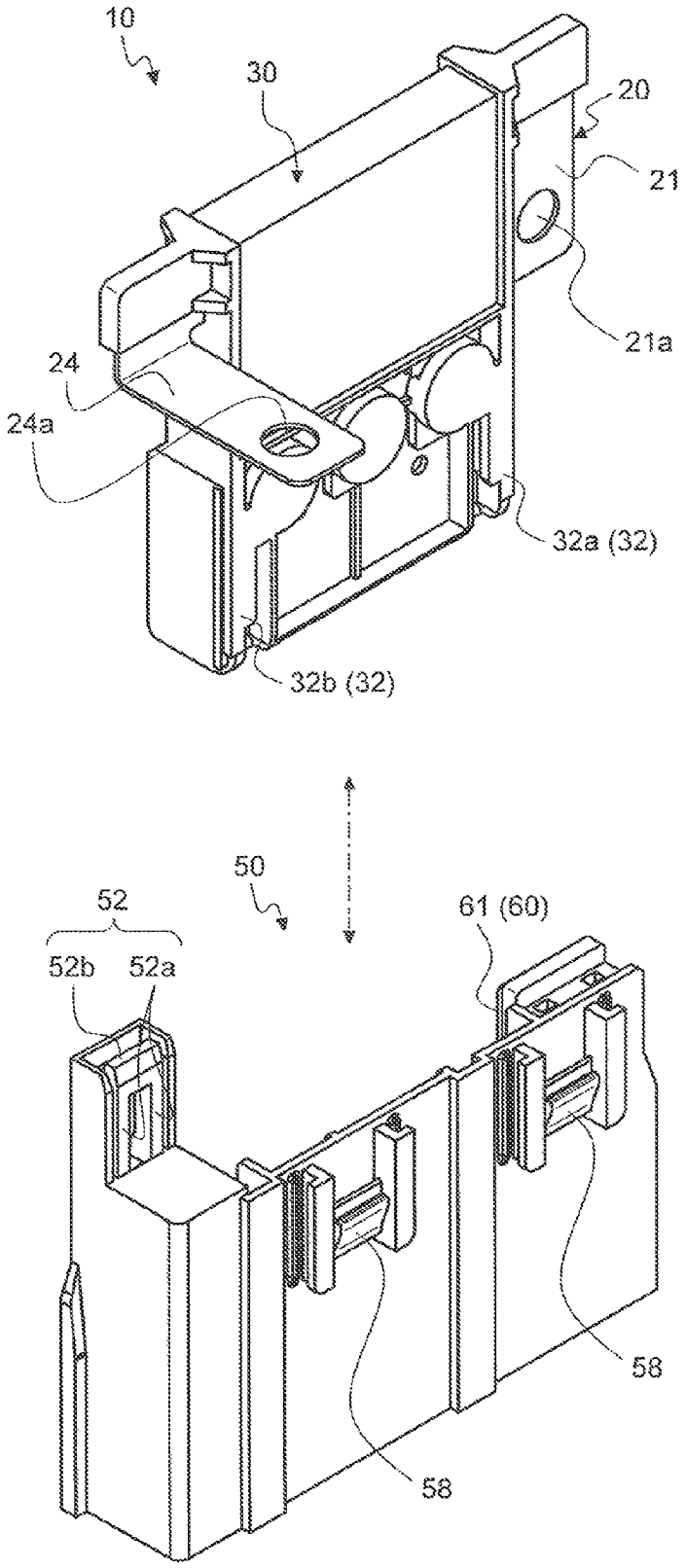
FIG. 9 is an exploded perspective view illustrating the circuit protection component and the protection component holding body according to the embodiment that are viewed from a rear side.

The engaging unit 51 includes two engaging bodies 51*a* and 51*b* having L-shaped sectional surfaces and extending in the respective insertion directions of the circuit protection component 10 and the protection component holding body 50. The engaging bodies 51*a* and 51*b* are parts projecting from a plane 53 along the insertion directions, and are disposed at intervals from each other. The housing member 30 of the circuit protection component 10 is provided with an engaging unit 32 that is engaged with the engaging unit 51 (FIG. 9). The engaging unit 32 includes two engaging bodies 32*a* and 32*b* having L-shaped sectional surfaces and extending in the insertion directions of the respective circuit protection component 10 and the protection component holding body 50. In the engaging unit 32 and the engaging unit 51, the circuit protection component 10 and the protection component holding body 50 are inserted into each other so as to engage the engaging bodies 32*a* and 32*b* with the engaging bodies 51*a* and 51*b*, respectively. These engaging units 32 and 51 regulate the movement between the circuit protection component 10 and the protection component holding body 50 in a direction other than the insertion directions.

Figure 8:
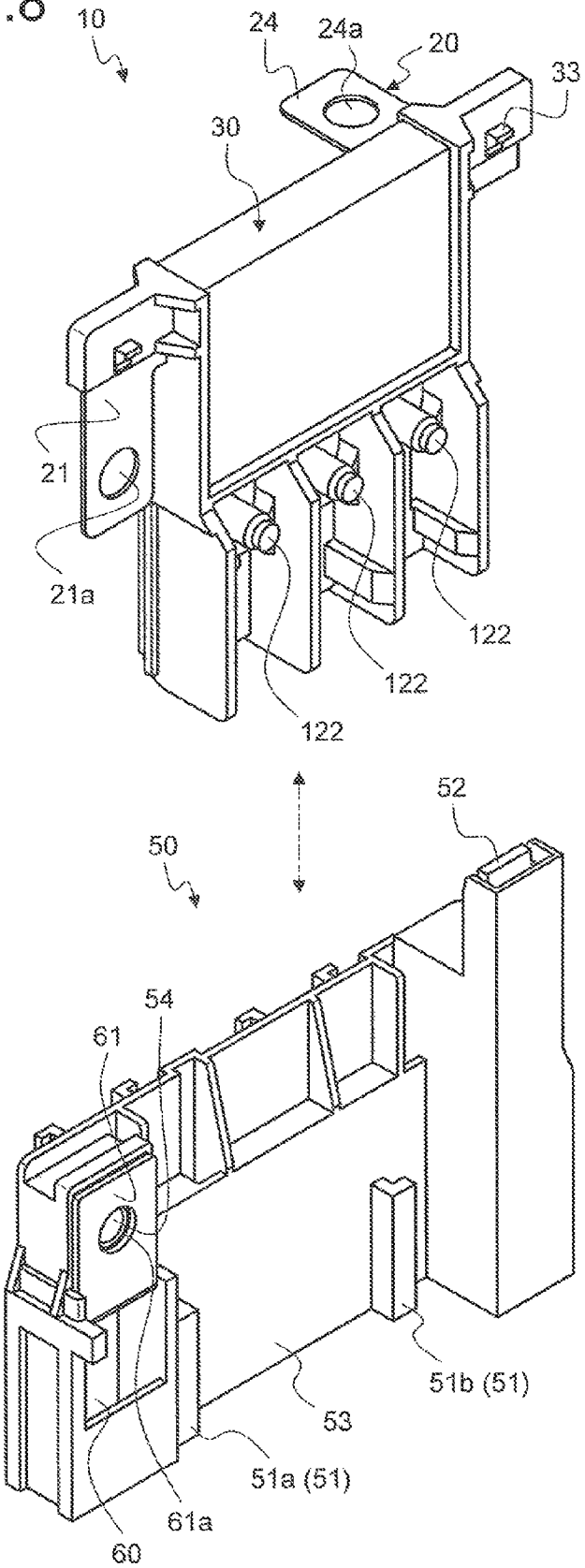
FIG. 8 is an exploded perspective view illustrating the circuit protection component and the protection component holding body according to the embodiment.

The locking unit 52 regulates the movement of the circuit protection component 10 and the protection component holding body 50 along the respective insertion directions. The locking unit 52 is formed into a U shape, and includes two shaft bodies 52*a* extending along the insertion directions and a locking piece 52*b* connecting one end parts of the shaft bodies 52*a* (end parts on a side where the circuit protection component 10 just before the insertion is disposed) to each other (FIG. 9). This locking unit 52 is integrated with the protection component holding body 50 through the other end parts of the shaft bodies 52*a*. This locking unit 52 is formed so as to perform tilting operation utilizing elasticity with the other end part as a fulcrum. The housing member 30 of the circuit protection component 10 is provided with a claw unit 33 that is locked by the locking piece 52*b* of the locking unit 52 (FIG. 8). In the claw unit 33 and the locking unit 52, due to mutual insertion of the circuit protection component 10 and the protection component holding body 50, the claw unit 33 tilts the locking unit 52 while pushing and moving the locking piece 52*b*, and the locking unit 52 returns to an original position at a time when the claw unit 33 enters the inside of the U shape of the locking unit 52. In this manner, the claw unit 33 and the locking unit 52 can regulate movement along the respective insertion directions of the circuit protection component 10 and the protection component holding body 50. In the circuit protection component 10 and the protection component holding body 50, movement to one side is regulated by locking operation between the claw unit 33 and the locking piece 52*b*, and movement to the other side is regulated by the respective appearance shapes of the circuit protection component 10 and the protection component holding body 50 (for example, parts where the circuit protection component 10 and the protection component holding body 50 contact each other upon completion of insertion).

This protection component holding body 50 is provided with the female screw unit 54 that is disposed concentrically to the through hole 21*a* of the power supply side connector 21 upon completion of insertion of the circuit protection component 10.

Figure 7:
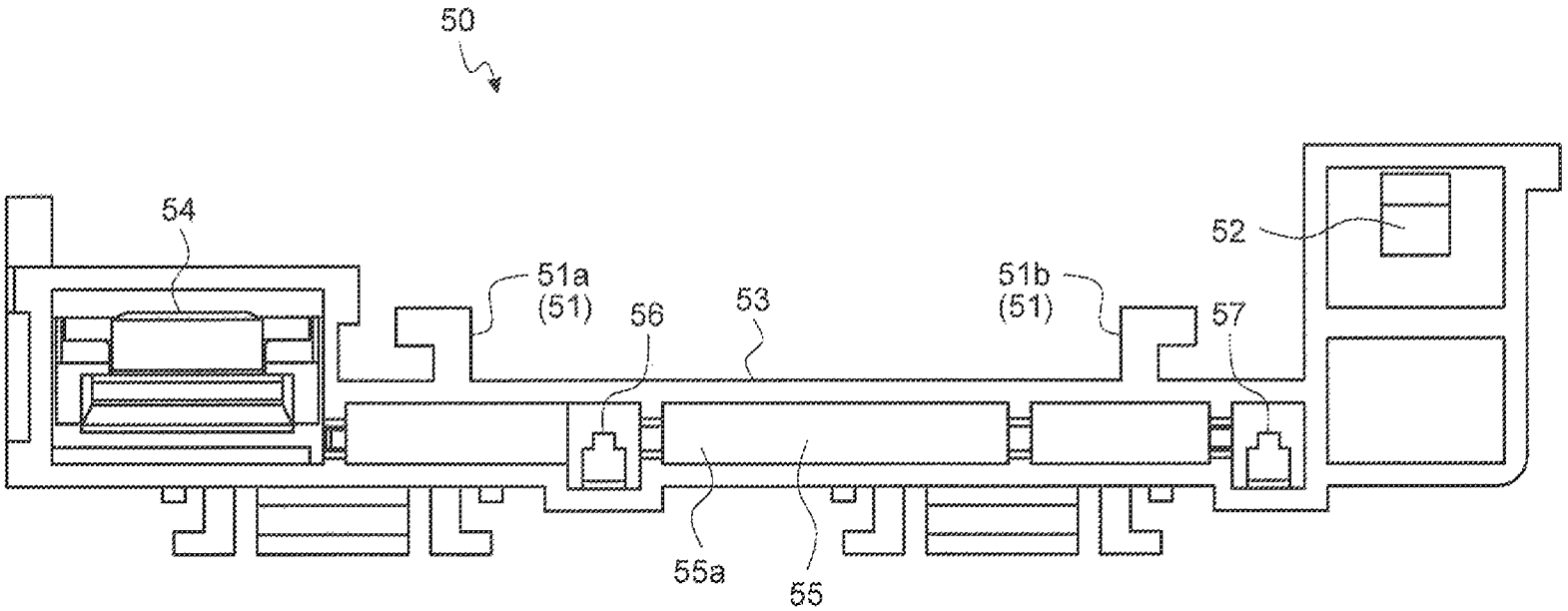
FIG. 7 is a bottom view illustrating the protection component holding body according to the embodiment.
Figure 10:
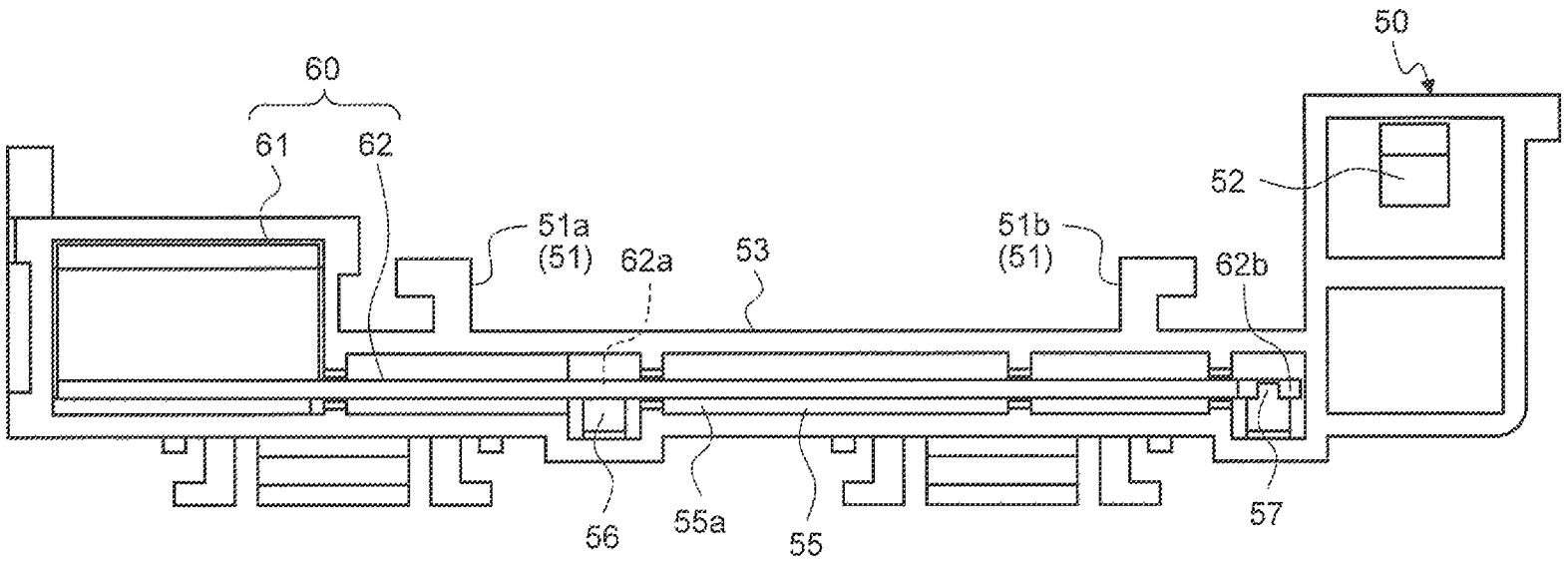
FIG. 10 is a bottom view illustrating the protection component holding body and the heat conductive member according to the embodiment.

In addition, this protection component holding body 50 is provided with an internal space 55 (FIG. 7). In the internal space 55, there is disposed a heat conductive member 60 capable of transferring and receiving heat with the power supply side connector 21 of the circuit protection component 10 (FIG. 10). The protection component holding body 50 includes the heat conductive member 60 inserted from an aperture 55*a* in the internal space 55 in a state where the heat conductive member 60 is communicated with the outside of the protection component holding body 50.

Figure 6:
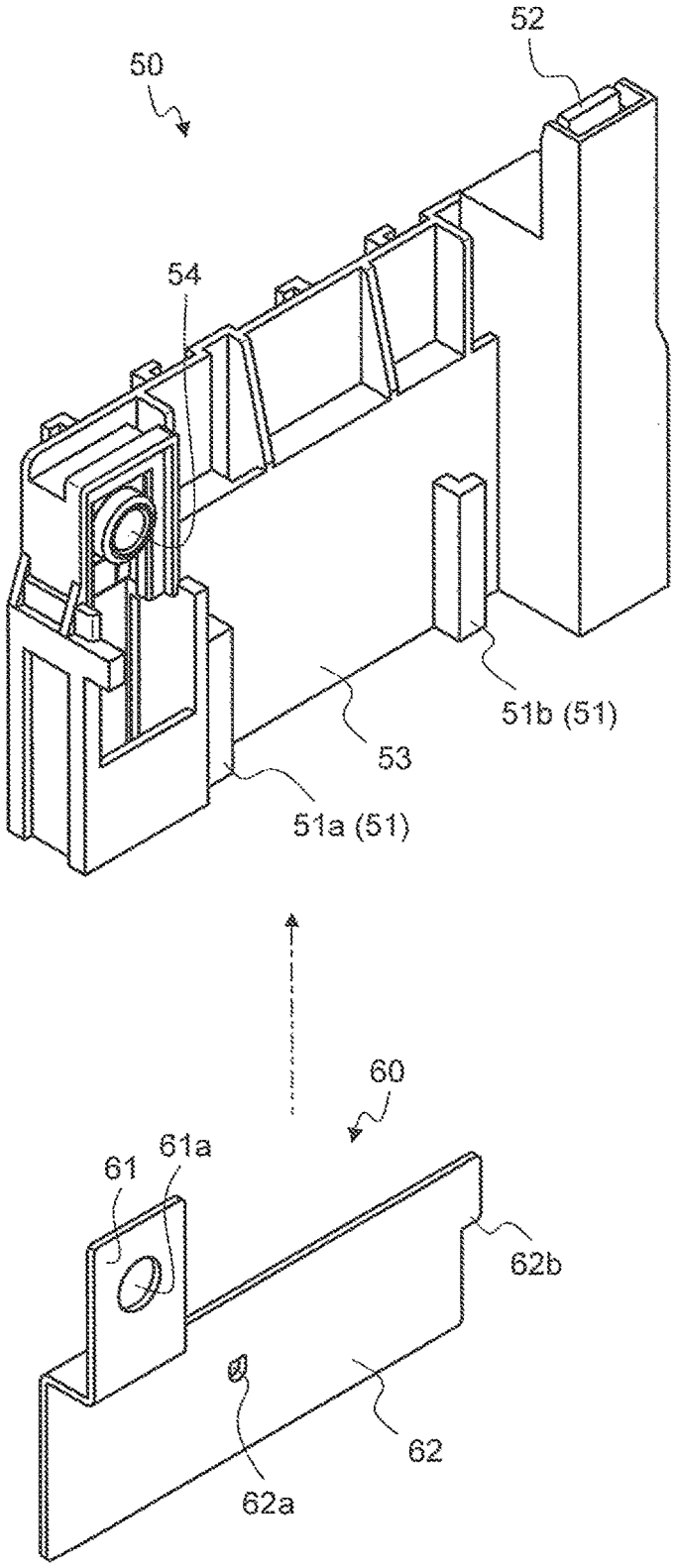
FIG. 6 is an exploded perspective view illustrating the protection component holding body and a heat conductive member according to the embodiment.

The heat conductive member 60 is formed by press-working a plate-like metal material. The heat conductive member 60 in the embodiment includes, in a state where the circuit protection component 10 is held by the protection component holding body 50, a contacting portion 61 that contacts the power supply side connector 21, and a heat conducting portion 62 that is connected to the contacting portion 61 (FIG. 6). In this example, both the contacting portion 61 and the heat conducting portion 62 are formed into substantially rectangular shapes.

In the heat conductive member 60 in the embodiment, the heat conducting portion 62 is provided with two locking units 62*a* and 62*b* (FIG. 6). The locking unit 62*a* is a through hole formed on the heat conducting portion 62. A claw unit 56 of the protection component holding body 50 provided to the internal space 55 is inserted into the locking unit 62*a*. The claw unit 56 is pushed and moved by the heat conducting portion 62 due to insertion of the heat conductive member 60 to be tilted from its base, and returns to an original position utilizing elasticity to be inserted into the locking unit 62*a* at a time when the heat conductive member 60 is inserted into a certain position of the internal space 55 (FIG. 10). The locking unit 62*b* is a projection that projects on the same plane as that of the heat conducting portion 62. This locking unit 62*b* is locked by a claw unit 57 of the protection component holding body 50 provided to the internal space 55. The claw unit 57 is pushed and moved by the locking unit 62*b* due to insertion of the heat conductive member 60 to be tilted from its base, and returns to an original position utilizing elasticity when the heat conductive member 60 is inserted into a certain position of the internal space 55 and the locking unit 62*b* rides over the claw unit 57 (FIG. 10). In this manner, an edge surface of the locking unit 62*b* is locked by the claw unit 57. The heat conductive member 60 is held at a certain position in the internal space 55 by the locking units 62*a* and 62*b* and the claw units 56 and 57.

A round through hole 61*a* is formed on the contacting portion 61 (FIG. 6). The through hole 61*a* is disposed concentrically to the female screw unit 54 in a state where the heat conductive member 60 is held by the protection component holding body 50. Thus, when the circuit protection component 10 is held by the protection component holding body 50, the through hole 61*a* is also disposed concentrically to the through hole 21*a* of the power supply side connector 21 and the through hole 111*a* of the terminal 111. The contacting portion 61 is interposed between the power supply side connector 21 and the female screw unit 54 (FIG. 5) as if the contacting portion 61 is sandwiched between the power supply side connector 21 and the female screw unit 54. Resultingly, when the female screw unit 54 and the male screw member 121 are screwed together, the power supply side connector 21, the contacting portion 61, and the terminal 111 are fastened together.

After the power supply side electric wires 101 and the load side electric wires 102 are installed, a joint body of the circuit protection component 10 and the protection component holding body 50 is inserted from one opening of the housing body 41 (opening on a lower side of a paper sheet of FIG. 1). In this manner, this joint body is housed in and held by the housing body 41.

Figure 11:
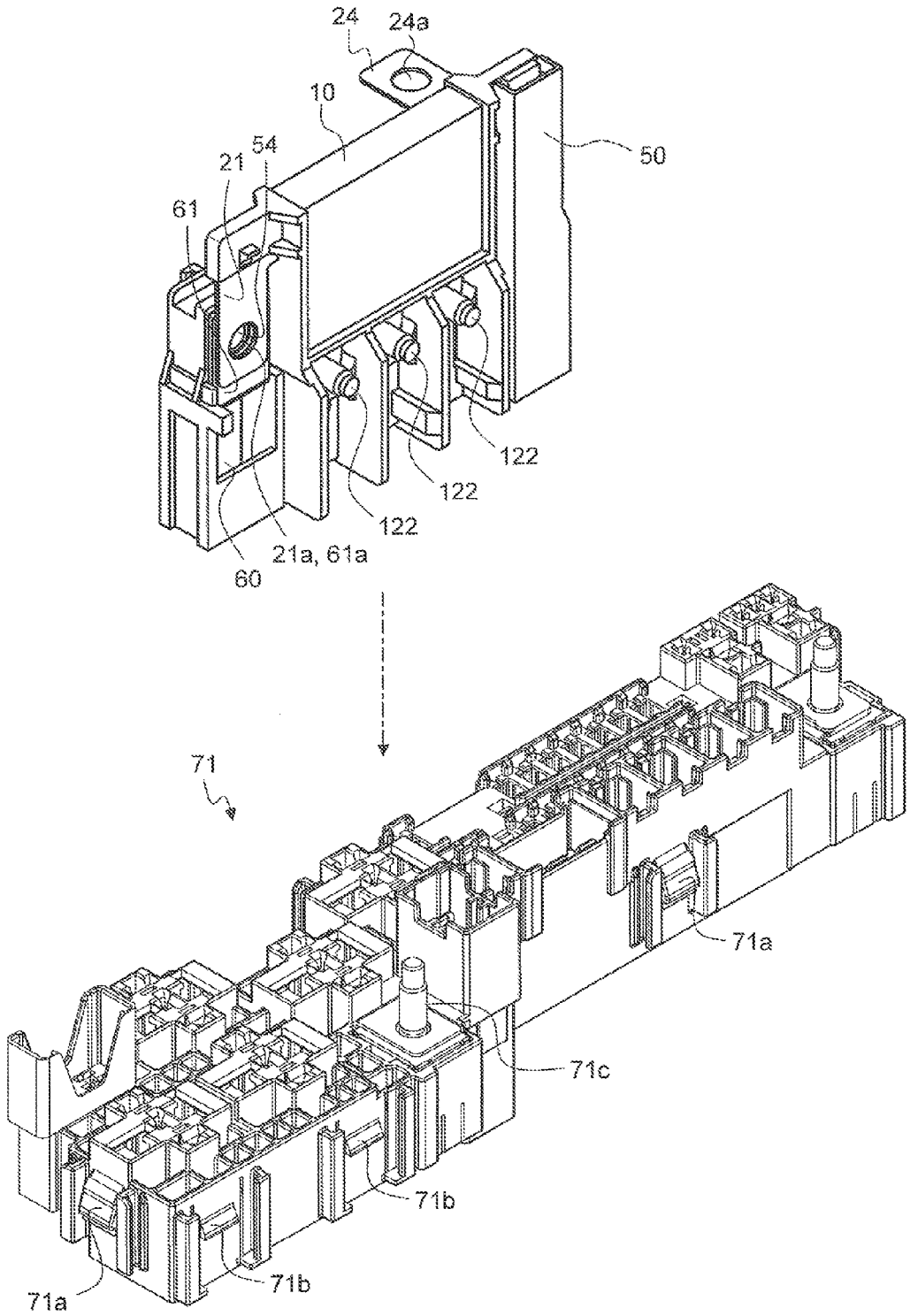
FIG. 11 is an exploded perspective view illustrating the joint body of the circuit protection component and the protection component holding body, and a protection component holding member according to the embodiment.
Figure 12:
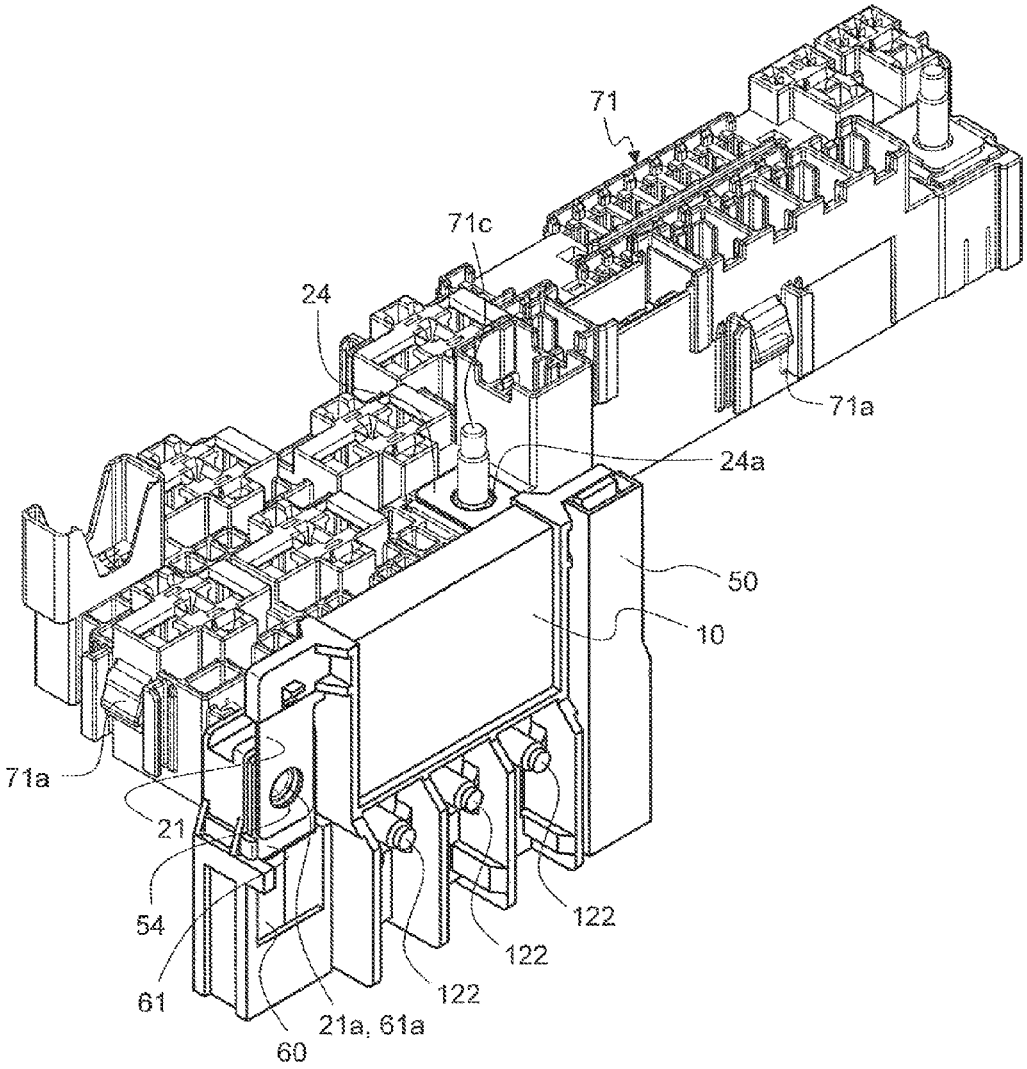
FIG. 12 is a perspective view illustrating a state where the joint body of the circuit protection component and the protection component holding body, and the protection component holding member according to the embodiment are assembled to each other.
Figure 13:
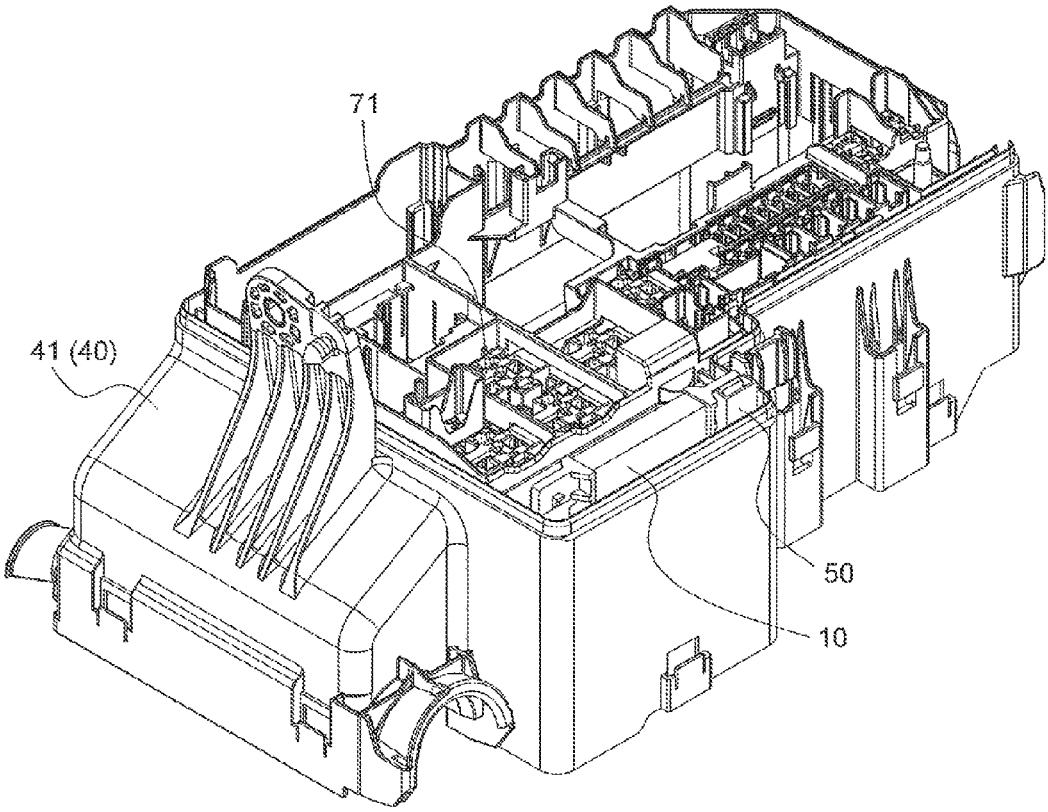
FIG. 13 is a perspective view illustrating a state where the circuit protection component according to the embodiment is housed in a housing body.

In the electric connection box 1 in the embodiment, for example, at least one fuse as other circuit protection components (not illustrated) is interposed between the circuit protection component 10 and the electric component 15. The fuse is housed in and held by the housing body 41 while being held by the protection component holding member (what is called, a fuse block) 71 illustrated in FIG. 1 and the like. The protection component holding member 71 is housed in the housing body 41, and is held by the housing body 41 through a plurality of engaging units 71*a* (FIG. 11). In the embodiment, the protection component holding member 71 also has a function of holding the protection component holding body 50. Thus, a holding mechanism is provided between the protection component holding body 50 and the protection component holding member 71 for engaging between the protection component holding body 50 with the protection component holding member 71 and causing the protection component holding member 71 to hold the protection component holding body 50. The holding mechanism is formed of two engaging units 58 (FIG. 9) provided to the protection component holding body 50 and two engaging units 71*b* (FIG. 11) provided to the protection component holding member 71. When the joint body of the circuit protection component 10 and the protection component holding body 50 is installed on the protection component holding member 71 (FIG. 12), the engaging units 58 and the engaging units 71*b* are engaged with each other, and keep engaged with each other until disengagement operation is performed. When the joint body is being installed on the protection component holding member 71, the through hole 24*a* of the piece unit 24 in the power supply side connector 21 is inserted through the cylindrical projecting unit 71*c* of the protection component holding member 71. For example, the joint body in the embodiment is housed in the housing body 41 while installed on the protection component holding member 71 (FIG. 13).

The power supply side electric wires 101 (the positive electrode side electric wire 101A and the negative electrode side electric wire 101B) are wired inside of the housing body 41, and are drawn out from an aperture 44A formed along with the joint of the housing body 41 and the first lid body 42 (FIG. 2). The load side electric wires 102 are wired inside of the housing body 41, and are drawn out from another aperture 44B formed along with the joint of the housing body 41 and the first lid body 42 (FIG. 2).

As described above, the electric connection box 1 and the wire harness WH in the embodiment are provided with the heat conductive member 60 that contacts the power supply side connector 21 of the circuit protection component 10. When a temperature of the power supply side connector 21 is higher than that of the contacting portion 61 of the heat conductive member 60, the contacting portion 61 can receive heat of the power supply side connector 21 and conduct the heat to the heat conducting portion 62 side. In this manner, in the electric connection box 1 and the wire harness WH, when heat of the power supply side electric wires 101 is conducted to the power supply side connector 21, the heat is radiated through the heat conductive member 60. For example, the heat conductive member 60 in the embodiment is communicated with the outside in the internal space 55 of the protection component holding body 50, and can pass the received heat to the surrounding air and release the received heat with the air from, for example, the aperture 55*a* to the outside. Thus, the electric connection box 1 and the wire harness WH can reduce heat conduction of the power supply side electric wires 101 to the fuse elements 23 side so as to prevent the fuse elements 23 from being fused before a current reaches a predetermined current value and improve the accuracy of the circuit protection component 10.

Conventionally, there have been taken measures for reducing an amount of heat conducted from the power supply side electric wires 101 side to the fuse elements 23 side by, for example, making the diameter of the power supply side electric wires 101 greater and reducing an amount of heat of the power supply side electric wires 101. However, the electric connection box 1 and the wire harness WH can reduce electric heat from the power supply side electric wires 101 side to the fuse elements 23 side without making the diameter of the power supply side electric wires 101 greater and reducing an amount of heat of the power supply side electric wires 101. Thus, in the electric connection box 1 and the wire harness WH, the power supply side electric wires 101 are pliable and flexibility in wiring of the power supply side electric wires 101 is increased as compared with a case where the diameter of the power supply side electric wires 101 is made greater. Resultingly, the electric connection box 1 and the wire harness WH can improve flexibility in self-disposition, and can improve installation workability on a vehicle body.

In an electric connection box and a wire harness according to the present invention, when a temperature of a power supply side connector is higher than that of a contacting portion of a heat conductive member, the contacting portion can receive heat of the power supply side connector and conduct the heat to a heat conducting portion side. In this manner, in the electric connection box and the wire harness, when heat of power supply side electric wires is conducted to the power supply side connector, the heat is radiated through the heat conductive member. Thus, the electric connection box and the wire harness can reduce heat conduction of the power supply side electric wires to a fuse element side so as to prevent fuse elements from being fused before a current thereof reaches a predetermined current value and improve the accuracy of a circuit protection component.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric connection box comprising:

a circuit protection component that is provided with a metal circuit protection member, the circuit protection member including a power supply side connector that is connected to power supply side electric wires connected to a power supply side, load side connectors, and fuse elements that are interposed between the power supply side connector and the load side connectors;

a housing that is formed of an insulating material, and includes a protection component holding unit that holds the circuit protection component; and a metal heat conductive member that includes a contacting portion contacting the power supply side connector in a state where the protection component holding unit holds the circuit protection component, and a heat conducting portion connected to the contacting portion, wherein each of the contacting portion and the heat conducting portion is a flat plate portion of the metal heat conductive member.

2. The electric connection box according to claim 1, wherein the protection component holding unit is a protection component holding body that is housed and held in the housing and being independent from the housing.

3. The electric connection box according to claim 1, wherein the protection component holding unit includes the heat conductive member in a state where the heat conductive member is communicated with outside of the protection component holding unit.

4. The electric connection box according to claim 2, wherein the protection component holding unit includes the heat conductive member in a state where the heat conductive member is communicated with outside of the protection component holding unit.

5. The electric connection box according to claim 1, wherein the housing is interposed between the load side connectors and the load, and holds an electric component that is electrically connected to the load side connectors and the load.

6. The electric connection box according to claim 2, wherein the housing is interposed between the load side connectors and the load, and holds an electric component that is electrically connected to the load side connectors and the load.

7. The electric connection box according to claim 3, wherein the housing is interposed between the load side connectors and the load, and holds an electric component that is electrically connected to the load side connectors and the load.

8. The electric connection box according to claim 1, wherein the circuit protection member includes the load side connector and the fuse element for each load that is to be connected to the electric connection box.

9. The electric connection box according to claim 2, wherein the circuit protection member includes the load side connector and the fuse element for each load that is to be connected to the electric connection box.

10. The electric connection box according to claim 3, wherein the circuit protection member includes the load side connector and the fuse element for each load that is to be connected to the electric connection box.

11. The electric connection box according to claim 5, wherein the circuit protection member includes the load side connector and the fuse element for each load that is to be connected to the electric connection box.

12. A wire harness comprising:

power supply side electric wires that are connected to a power supply side;

load side electric wires that are connected to a load side;

a circuit protection component that is provided with a metal circuit protection member, the circuit protection member including a power supply side connector that is electrically connected to the power supply side electric wires, load side connectors that are electrically connected to the load side electric wires, and fuse elements that are interposed between the power supply side connector and the load side connectors;

a housing that is formed of an insulating material and, includes a protection component holding unit that holds the circuit protection component; and a metal heat conductive member that includes a contacting portion contacting the power supply side connector in a state where the protection component holding unit holds the circuit protection component, and a heat conducting portion connected to the contacting portion, wherein each of the contacting portion and the heat conducting portion is a flat plate portion of the metal heat conductive member.

13. The wire harness according to claim 12, wherein the power supply side connector is sandwiched between the contacting portion and the terminal.

14. The electric connection box according to claim 1, wherein each of the contacting portion and the power supply side connector is a flat plate portion that includes a through hole.

15. The electric connection box according to claim 1, wherein the circuit protection component further includes a housing member that encloses the fuse elements and exposes the power supply connector and the load side connectors, and the heat conducting portion is outside of the housing.

16. The electric connection box according to claim 1, wherein the protection component holding unit is a protection component holding body, the heat conducting portion is mounted to the protection component holding body, and the circuit protection component is outside of the protection component holding body.

17. The electric connection box according to claim 1, wherein the protection component holding unit is a protection component holding body that includes a internal space, an aperture in communication with the internal space, and a supporting portion outside of the internal space, the internal space receives the metal heat conductive member therein, and the supporting portion receives the contacting portion thereon.

18. The electric connection box according to claim 1, wherein the circuit protection component further includes a housing member that encloses the fuse elements and exposes the power supply connector and the load side connectors, and the housing includes a housing engaging portion, and the protection component holding unit is a protection component holding body, the protection component holding body includes a internal space, an aperture in communication with the internal space, a supporting portion outside of the internal space, and a body engaging portion, the internal space receives the metal heat conductive member therein, and the supporting portion receives the contacting portion thereon, and the body engaging portion engages the housing engaging portion such that the housing member is secured to the protection component holding body.

* * * * *